United States Patent [19]

Kimura et al.

[11] Patent Number: 4,825,486

[45] Date of Patent: May 2, 1989

[54] BEDSORE-PREVENTING AIR MATTRESS CONTROLLER

[75] Inventors: Rokusaburo Kimura, Kobe; Yoshie Watari, Osaka; Satoshi Nakayama, Nara; Haruhiko Naruse, Shijonawate, all of Japan

[73] Assignee: Matsushita Electric Works, Ltd., Osaka, Japan

[21] Appl. No.: 137,584

[22] Filed: Dec. 24, 1987

[30] Foreign Application Priority Data

Jun. 5, 1987 [JP] Japan ..... 62-142098

[51] Int. Cl.[4] ..... A47C 27/10

[52] U.S. Cl. ..... 5/453; 5/455

[58] Field of Search ..... 5/453, 455, 456

[56] References Cited

U.S. PATENT DOCUMENTS 2,719,986 10/1955 Rand ..... 5/453
3,587,568 6/1971 Thomas ..... 5/453 X
3,653,083 4/1972 Lapidus ..... 5/450
4,175,297 11/1979 Robbins et al. ..... 5/447
4,197,837 4/1980 Tringali et al. ..... 5/453 X
4,391,009 7/1983 Schild et al. ..... 5/455 X
4,653,130 3/1987 Senoue et al. ..... 5/453

*Primary Examiner*—Gary L. Smith
*Assistant Examiner*—Michael Milano
*Attorney, Agent, or Firm*—Burns, Doane, Swecker & Mathis

[57] ABSTRACT

A bedsore-preventing air mattress controller provided with an air pump for generating a magnetomotive force in a plurality of stages proportional to the feed air amount of the pump, and with an electric switch for changing over the magnetomotive force of the pump and integrally assembled with an air shut-off valve for discharging and halting air, whereby the controller arrangement is simplified to effectively reduce the required number of parts for lowering manufacturing costs.

17 Claims, 7 Drawing Sheets

AC
24
24a
60
61
69
71
73
73a
74
74a
75
75a
13A
160
161
162
171
172
173
173a
174
174a

BEDSORE-PREVENTING AIR MATTRESS CONTROLLER

TECHNICAL BACKGROUND OF THE INVENTION

This invention relates to a controller including an air pump for feeding an air for a predetermined period to an air mattress for the purpose of bedsore prevention.

The controller of the kind referred to can be effectively utilized in cyclically varying the fed air to the air mattress for the purpose of preventing any bedsore likely to occur in patients who are required to be in bed for a long period, by varying surface state of the air mattress on which the patient is lying.

DISCLOSURE OF PRIOR ART

There have been suggested various types of bedsore preventing mattresses, in one of which shown in U.S. Pat. No. 3,653,083 to Roy Lapidus, air cells of different diameters are sequentially arranged and air is supplied to and discharged from relatively larger diametered air cells to vary surface state of the mattress; in another of which of U.S. Pat. No. 4,653,130 to Masaharu Senoue et al, first and second groups of air cells and a further group of smaller diametered air cells having many upward open holes for ventilation are provided for the surface state changing by alternately and sequentially inflating and deflating the first and second group air cells; and so on. With respect to these bedsore preventing mattresses, such a controller as disclosed in, for example, U.S. Pat. No. 4,175,297 to William E. Robbins et al may be employed, in which a controller is provided for the air supply and discharge with respect to the first and second group air cells with an optimum operation of air-flow change-over valve for alternate air supply from an air pump to the air cell groups by means of an electric controlling circuit associated with a cycle timer. While the mattress surface condition can be varied by the controller, there have been such problems that, with the arrangement of Robbins et al, many constituent parts are required for the controlling circuit, timer and so on, so that the required number of the parts are increased, and the size of the controller is enlarged to render the cost to become high.

FIELD OF ART

A primary object of the present invention is, therefore, to provide a bedsore-preventing air mattress controller which has made any electric control circuit parts to be substantially unnecessary, whereby required parts number is attempted to be reduced to minimize in size the controller and to lower required costs for manufacturing the same.

According to the present invention, this object is realized by providing a controller for bedsore preventing air mattress which comprises first and second groups of air cells inflatable and deflatable and a plurality of air cells disposed between the respective air cells of the first and second groups and provided for discharging air, the air being fed from a pump through a change-over valve to the first and second groups of the air cells and through a shut-off valve to the air discharging cells so that the first and second groups of air cells will be alternately inflated and deflated with the air discharging cells actuated and halted, wherein the air pump comprises coils providing magnetomotive force proportional to feed air amount at a plurality of stages, and an electric switch for changing over the magnetomotive force generation of the air pump is provided for simultaneous operation with the shut-off valve for the air discharging cells.

Other objects and advantages of the present invention should be made clear in the following description of the invention detailed with reference to such embodiments thereof as shown in accompanying drawings.

Figure 1:
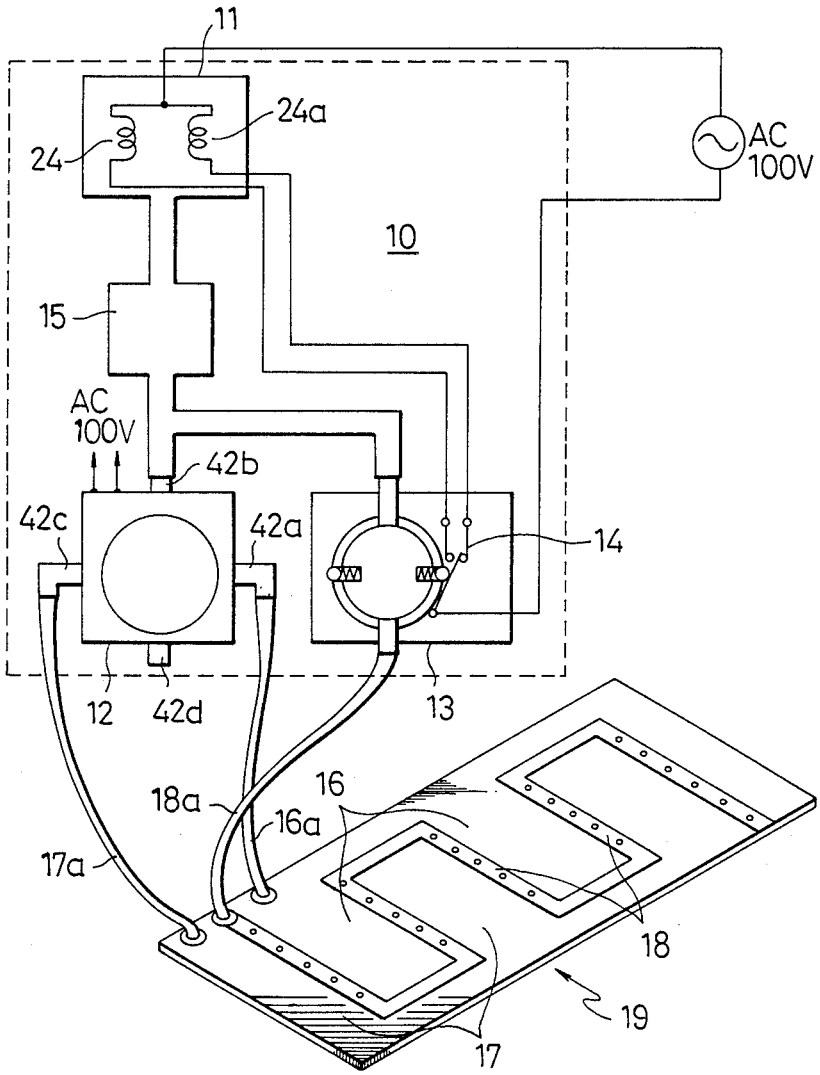
FIG. 1 is an explanatory view for an entire arrangement of the bedsore-preventing air mattress controller according to the present invention.

While the invention shall now be explained with reference to the embodiments shown in the drawings, the intention is not to limit the invention only to the embodiments shown but to cover all alterations, modifications, and equivalent arrangements possible within the scope of appended claims.

DISCLOSURE OF PREFERRED EMBODIMENTS

Referring to FIG. 1, a controller 10 according to the present invention comprises an air pump 11, an air flow change-over valve 12 coupled to the pump 11, an air shut-off valve 13 also coupled to the pump 11, an electric switch 14 connected to the pump 11 and air shut-off valve 13, and a silencer tank 15 disposed between the pump 11 and the both valves 12 and 13 for absorbing any pulsating of supplied air from the pump 11, and the controller 10 is arranged to controllably supply air to the first and second groups of pneumatically expandible and contractible air cells 16 and 17 as well as a third group of ventilating air cells 18 disposed between the first and second group air cells 16 and 17, which air cells 16 through 18 form a bedsore preventing air mattress 19.

Figure 2:
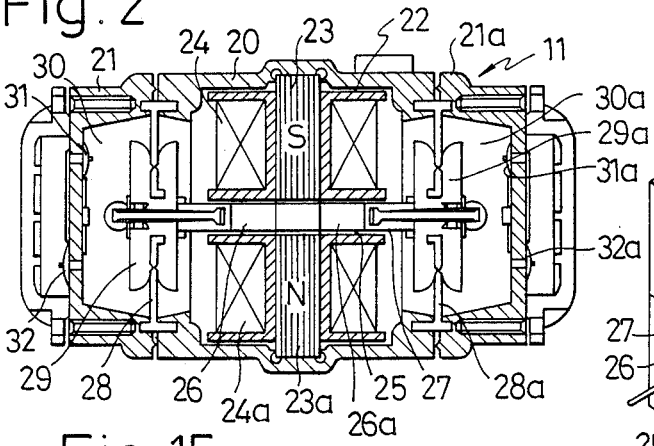
FIG. 2 is a vertically sectioned view of an air pump used in the controller of FIG. 1.
Figure 3:
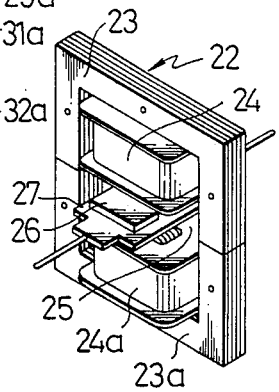
FIG. 3 is a perspective view of an electromagnetic block in the air pump of FIG. 2.

Referring here to FIGS. 2 and 3, the air pump 11 comprises a center casing 20 and compression-chamber casings 21 and 21*a* secured to both open ends of the center casing 20, and an electromagnetic block 22 is housed within the center casing 20, which block 22 comprises core members 23 and 23*a* carrying coils 24 and 24*a* wound respectively on each of the core members 23 and 23*a* to be independent of each other and a movable member 27 carrying permanent magnets 26 and 26*a* and inserted into an air gap 25 defined between the core members and coils. The movable member 27 is coupled at both .extended ends to diaphragms 28 and 28*a* at their center plates 29 and 29*a*, while the diaphragms 28 and 28*a* are secured at their peripheral parts held between the center casing 20 and the compression-chamber casings 21 and 21*a* so that the diaphragms 28 and 28*a* will resiliently hold the both ends of the movable member 27 and respectively define a part of compression chambers 30 and 30*a* provided within the both casings 21 and 21*a*. With an AC voltage Vs applied to the coils 24 and 24*a* of the electromagnetic block 22 connected to a commercial power source AC, the movable member 27 is driven to shift across the both diaphragms 28 and 28*a*, in one direction during each positive half cycle of the AC power and in the other direction during each negative half cycle of the AC power. The movable member 27 thus driven to shift towards the side of one 30 of the compression chambers renders this compression chamber 30 to be at a higher pressure, an inlet valve means 31 mounted to the chamber 30 is thereby closed whereas an outlet valve means 32 also of the chamber 30 is caused to open by the higher pressure in the chamber 30, and air inside the compression chamber 30 is discharged. At the same time, the other compression chamber 30*a* is made to be at a lower pressure, an inlet valve means 31*a* of the chamber 30*a* is thereby opened while an outlet valve means 32*a* of the chamber is closed so that air is led into the chamber 30*a*. With the movable member 27 driven to shift towards the other side, an operation opposite to the above is carried out.

Figure 4A:
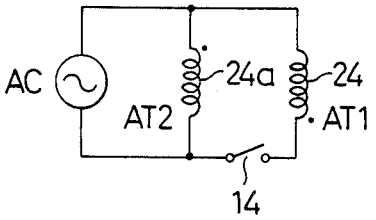
FIGS. 4(*a*) and 4(*b*) are a circuit diagram of the air pump of FIG. 2 in which a pair of coils employed therein are equal in ampere turn, and a characteristic diagram of the pump, respectively.
Figure 4B:
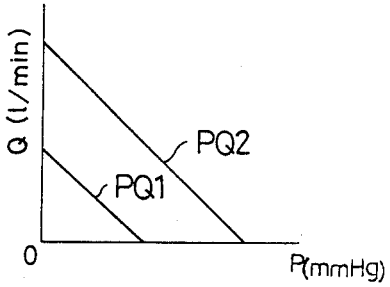

When the coils 24 and 24*a* are made to be identical to each other in their ampere turns AT1 and AT2, the coil 24*a* is connected in parallel to the power source AC and the coil 24 is connected through the electric switch 14 in parallel to the coil 24*a*, as shown in FIG. 4(*a*). When the switch 14 is turned off in this arrangement, the pump 11 shows such characteristics in the relationship between the pressure P and the feed air amount Q of FIG. 4(*b*) as a straight line PQ1 due to a magnetomotive force of only the coil 24*a* whereas, when the switch 14 is turn on, the both coils 24 and 24*a* simultaneously excited cause such characteristics as shown by the other straight line PQ2 to be shown. That is, the feed air amount of the air pump 11 can be made variable by changing over the connection of the two coils 24 and 24*a* which are of the same specification.

Figure 5A:
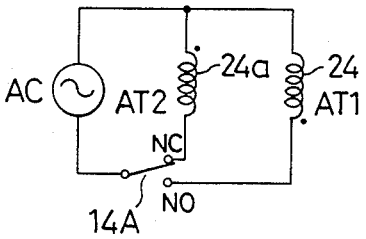
FIGS. 5(*a*) and 5(*b*) are a circuit diagram of the air pump of FIG. 2 in which the coils are different in the ampere turn, and a characteristic diagram of the pump, respectively.
Figure 5B:
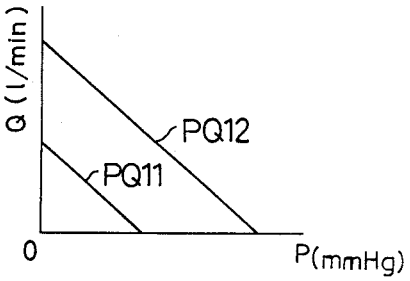

The coils 24 and 24*a* may be made different in their ampere turns AT1 and AT2 so as to be, for example, AT1>AT2, in which event the both coils 24 and 24*a* are connected in parallel to the power source AC and an electric switch 14A having normally closed contact NC and normally opened contact NO is inserted between the source AC and the coils 24 and 24*a*, with the normally closed contact NC connected to the coil 24*a* and the normally opened contact NO to the other coil 24, as shown in FIG. 5(*a*). In this case, too, in the relationship between the pressure P and the feed air amount Q as in FIG. 5(*b*), the switch 14A turned to shift its movable contactor to the side of the normally closed contact NC causes characteristics of a straight line PQ11 due to the magnetomotive force of only the coil 24*a* of the relatively smaller ampere turn AT2, whereas the switch 14A turned to shift the movable contactor to the normally opened contact NO side causes characteristics of another straight line PQ12 due to the magnetomotive force of the other coil 24 of the relatively larger ampere turn AT1, and the feed air amount of the air pump 11 can be made variable.

Figure 6A:
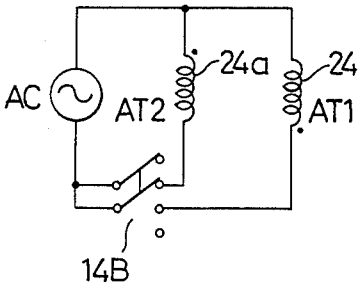
FIGS. 6(*a*) and 6(*b*) are a circuit diagram of the air pump of FIG. 2 in which the excitation of a pair of coils is changed over in three stages, and a characteristic diagram of the pump, respectively.
Figure 6B:
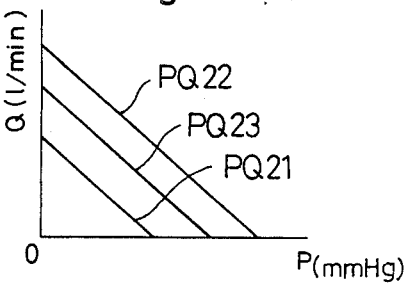

If required, further, it may be possible to vary the feed air amount from the air pump 11 in three stages. In that event, the ampere turns AT1 and AT2 are made to be AT1>AT2 and, as shown in FIG. 6(*a*), an electric switch 14B which takes three positions including a first position of connecting the power source AC only to the coil 24*a*, a second position of connecting the source AC to both of the coils 24 and 24*a* and a third position of connecting the source AC only to the coil 24, is inserted between the power source AC and the coils 24 and 24*a*. In the relationship between the pressure P and the feed air amount Q as shown in FIG. 6(*b*), the switch 14B placed in the first position causes characteristics of a straight line PQ21 due to the magnetomotive force of only the coil 24*a* of a relatively small ampere turn AT2; with the switch 14B placed in the second position, the magnetomotive forces of the both coils 24 and 24*a* are made effective to have characteristics of another straight line PQ22 shown; and with the switch 14B placed in the third position, characteristics of a further straight line PQ23 due to the magnatomotive force of only the coil 24 of a relatively larger ampere turn AT1, whereby the three stage variable air feed can be achieved by the pump 11.

In the air pump 11 according to the present invention, the drive force of the electromagnetic block 22 with respect to the movable member 27 is substantially proportional to the number of the ampere turn of the respective coils 24 and 24*a*, as will be clear from the foregoing, and this action is utilized in combination with the different types of the electric switches properly selected, so that the discharged air amount out of the air pump 11, that is, the feed air amount through the change-over valve 12 and shut-off valve 13 to the bedsore preventing mattress 19 can be varied in a plurality of stages.

Figure 7:
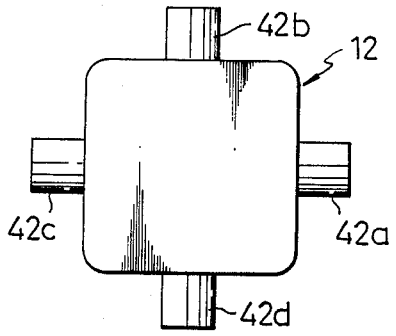
FIG. 7 is a top plan view of the air-flow change-over valve in the controller of FIG. 1.
Figure 8:
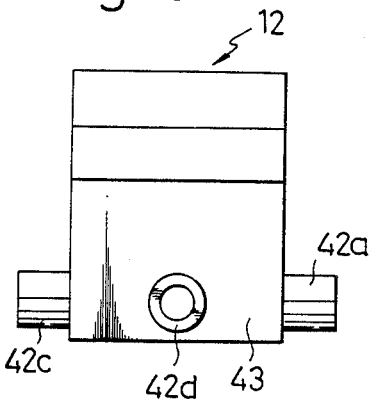
FIG. 8 is a front view of the change-over valve shown in FIG. 7.
Figure 9:
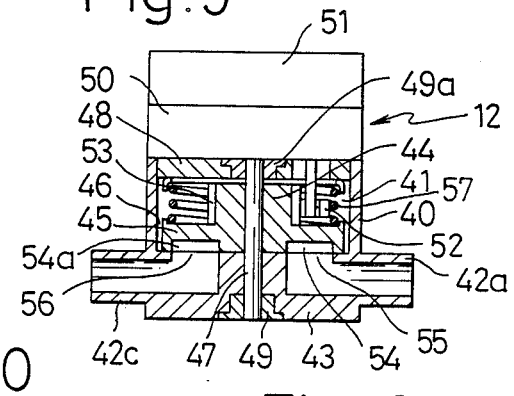
FIG. 9 is also the front view of the valve of FIG. 8 but with part thereof shown in section.

Referring also to FIGS. 7 to 9, the air change-over valve 12 is provided for performing air-flow change-over action automatically at an optimum cycle. Thus, the change-over valve 12 comprises a body 43 having therein a cavity 41 enclosed by peripheral walls 40 including three connecting ports 42*a* to 42*c* and one discharging port 42*d*, and a rotary member 46 having small-diametered and large-diametered portions 44 and 45 and accommodated in the cavity 41, so as to be formed in a so-called rotary type. An axial pivot shaft 47 is secured to this rotary member 46, and the shaft 47 is born at both extended ends rotatably by bushes 49 and 49*a* respectively embedded in bottom wall of the body 43 and in a cover plate 48 fitted the top opening of the body 43 to close the cavity 41. In the body 43, with a reduction gear 50 interposed, a driving source 51 comprising preferably a synchronous motor is joined integral with the body, an output pinion 52 of the reduction gear 50 for reducing the rotary torque of the driving source 51 projects into the cavity 41 to be in mesh with gear teeth 53 provided peripherally about the small-diametered portion 44 of the rotary member 46, and thereby the rotary driving by means of the driving source 51, energized for the rotary member 46 is reduced in the speed.

Figure 10:
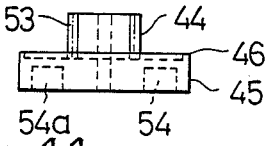
FIGS. 10 and 11 are a front view and a bottom view of the rotary member employed in the change-over valve of FIG. 7, respectively.
Figure 11:
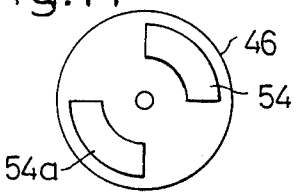
Figure 12:
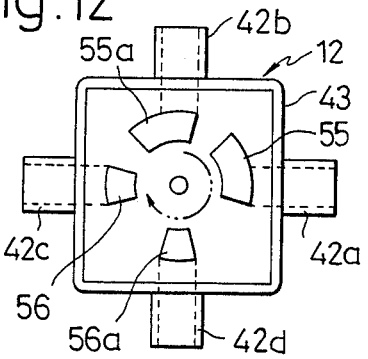
FIG. 12 is plan view with a cover member removed of the change-over valve of FIG. 7.
Figure 13A:
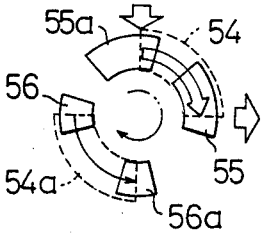
FIGS. 13(*a*) through 13(*f*) are explanatory views for the operation of the change-over valve of FIG. 7.
Figure 13B:
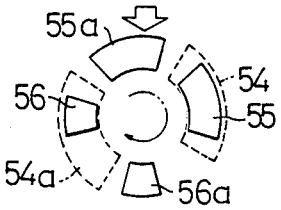
Figure 13C:
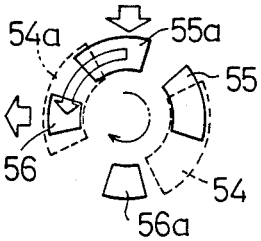
Figure 13D:
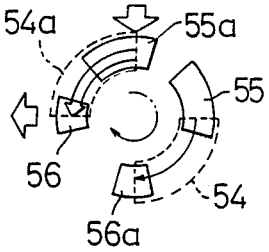
Figure 13E:
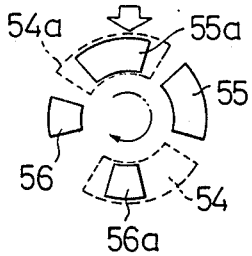
Figure 13F:
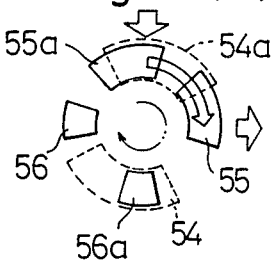

In the large-diametered portion 45 of the rotary member 46, as will be clear when FIGS. 10 and 11 are also referred to, there are provided arcuate communicating recesses 54 and 54*a* which are opened to the bottom face of the portion and expanding substantially over 90 degrees in the rotary angle in symmetrical relationship with respect to the pivot shaft 47. In the body 43, as will be clear when FIG. 12 is also referred to, there are formed a pair of flow paths 55 and 55*a* opened in the bottom face to be arcuate substantially over a range of 60 degrees in the rotary angle and communicating respectively with each of adjacent two of the connecting ports 42*a* and 42*b*, as well as a further pair of flow paths 56 and 56*a* also opened in the bottom face to be arcuate substantially over 30 degrees in the rotary angle and communicating respectively with the remaining connecting port 42*c* and with its adjacent discharge port 42*d*. Within the cavity 41, the rotary member 46 receives a spring load of a compression spring 57 fitted about the small-diametered portion 44 and between the top face of the large-diametered portion 46 and the cover plate 48, so that the bottom face of the portion 46 having the communicating recesses 54 and 54*a* will be urged against the inner bottom face in the cavity 41 of the body 43 having the respective flow paths 55, 55*a* and 56, 56*a*.

When the rotary member 46 is in a position of the rotary angle of zero in the air-flow change-over valve 12 according to the present invention, as shown in FIG. 13(*a*) in conjunction with FIG. 1, the fed air from the air pump 11 to the connecting port 42*b* is led, through the flow path 55*a* of the body 43, the communicating recess 54 of the rotary member 46, the other flow path 55 of the body 43 and a hose 16*a* coupled to the connecting port 42*a*, to the first group of air cells 16 of the mattress 19, and the cells 16 are inflated and expanded. In this state, the second group of air cells 17 connected through a hose 17*a* to the connecting port 42*c* of the valve 12 is deflated to discharge air through the hose 17*a*, port 42*c*, communicating recess 54*a* of the rotary member 46, flow path 56*a* of the body 43 and discharge port 42*d* to the exterior, and the cells 17 are contracted. Upon rotation of the rotary member 46 by 30 degrees in clockwise as in FIG. 13(*b*), the communicating recesses 54 and 54*a* of the rotary member 46 do not communicate with the connecting and discharge ports 42*b* and 42*d* but only with the connecting ports 42*a* and 42*c*, so that the first group of air cells 16 are kept in the inflated state and the second group of air cells 17 are in the deflated state.

Upon rotation by 60 degrees of the rotary member 46, as in FIG. 13(*c*), the communicating recess 54 of the rotary member 46 is still communicating with the connecting port 42*a* of the body 43, while the other communicating recess 54*a* comes into communication through the flow path 55*a* with the connecting port 42*b* while keeping the communication through the flow path 56 with the connecting port 42*c*, the fed air from the pump 11 starts being led through the hose 17*a* to the second group of air cells 17 which are thereby caused to be inflated. When the rotary member 46 is further rotated by 90 degrees from the zero degree position of FIG. 13(*a*) to a position of FIG. 13(*d*), a state opposite to FIG. 13(*a*) is reached, where the fed air from the pump 11 is led, through the connecting port 42*b*, flow path 55*a*, the other recess 54*a*, the other flow path 56, connecting port 42*c* and hose 17*a*, to the second group air cells 17 to keep them inflated, while air in the first group air cells 16 is discharged through the hose 16*a*, connecting port 42*a*, flow path 55, recess 54 in the rotary member 46, flow path 56*a* and discharge port 42*d* to the exterior, and the air cells 16 are deflated. In a state where the rotary member 46 is rotated by 120 degrees as in FIG. 13(*e*), the communicating recesses 54 and 54*a* are not communicating with the connecting ports 42*c* and 42*a* but only with the remaining connecting and discharge ports 42*b* and 42*d*, and the second group air cells 17 are kept in the inflated state while the first group air cells 16 are in the deflated state.

Figure 14:
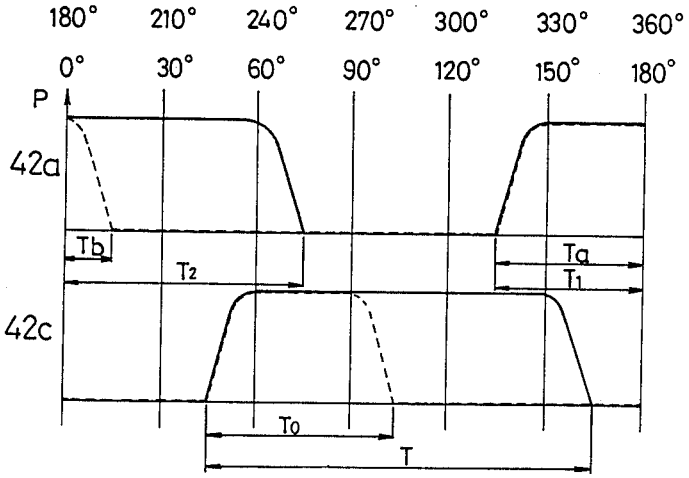
FIG. 14 is a time chart for explaining the operation of the valve shown in FIG. 7.

Upon rotation by 150 degrees of the rotary member 46, as shown in FIG. 13(*f*), the communicating recess 54 remains in the communication with the discharge port 42*d* only whereas the other communicating recess 54*a* comes into communication through the flow path 55 with the connecting port 42*a* in addition to the still maintained communication through the flow path 55*a* with the connecting port 42*b*, so that the fed air from the pump 11 starts being led through the hose 16*a* to the first group air cells 16 to inflate and expand them. As the rotary member 46 rotates 180 degrees, the state of FIG. 13(*a*) is reached again, and the foregoing inflation and deflation cycle is repeated. As seen also in FIG. 14 showing the air feeding state at the connecting ports 42*a* and 42*c*, the inflation and deflation of the first and second groups of air cells 16 and 17 are alternately repeated during every rotation by 180 degrees of the rotary member 46. In this case, the inflating time T is represented by $T=T_1+T_2$ commonly for both of the first and second groups of air cells 16 and 17, and the deflating or air discharging time $T_0$ is also represented by $T_0=T_a+T_b$ commonly. Further, the connecting ports 42*a* and 42*c* are made respectively to overlap only with one of the communicating recesses 54 and 54*a* of the rotary member 46 so that neither one of the recesses 54 and 54*a* is to be positioned across the both ports 42*a* and 42*c*, and any pressure interference is prevented from occurring between the connecting ports 42*a* and 42*b*.

Figure 15:
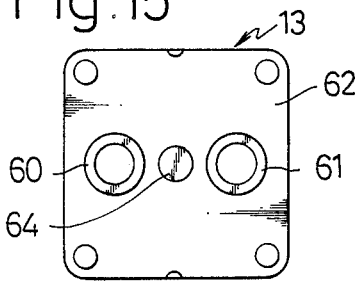
FIG. 15 is a plan view of the air shut-off valve in the controller of FIG. 1.
Figure 17:
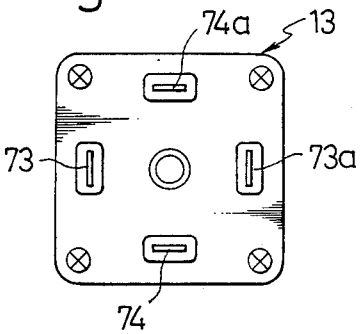
FIG. 17 is a bottom view of the valve of FIG. 15.
Figure 16:
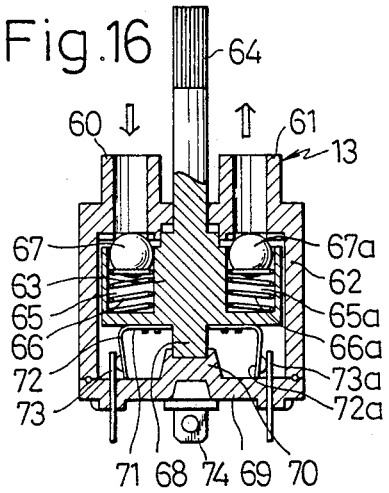
FIG. 16 is a vertically sectioned view of the valve of FIG. 15.
Figure 18:
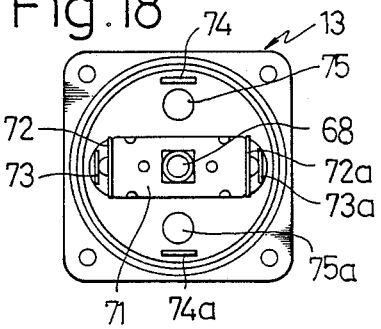
FIG. 18 is a bottom view of the valve of FIG. 15 with a terminal plate removed for showing the interior.

Referring now to FIGS. 15 and 16, the air shut-off valve 13 comprises a cylindrical housing 62 having upward extended inlet port 60 and outlet port 61 and opened at lower end, and an operating member 63 is rotatably housed within the housing 62. The operating member 63 is formed to have an axially upward extending operating portion 64 projecting out of the housing 62, and a pair of upward opened recesses 65 and 65*a* aligned with the inlet and outlet ports 60 and 61 of the housing 62, while compression coil springs 66 and 66*a* and slidable balls 67 and 67*a* are placed in these recesses 65 and 65*a* so that the balls 67 and 67*a* are resiliently urged against inner top face of the housing 62 to be slidable along as the operating member 63 is rotated for engaging in inner openings of the inlet and outlet ports 60 and 61 to resiliently close the ports, as urged by the springs 66 and 66*a* upon alignment with these ports.

Further, the operating member 63 is provided on the bottom face with a downward pivoting projection 68 which is held in a receptacle 70 made inside a terminal plate 69 airtightly fitted to the open lower end of the housing 62. The operating member 63 carries a movable contactor 71 secured to the bottom face of the member 63, a pair of downward extended legs 72 and 72*a* of which contactor 71 being contactable, as the member 63 is rotated, with two pairs of terminals 73, 73*a* and 74, 74*a* planted to the terminal plate 69 to be mutually symmetrical with respect to the operating member 63. In these pairs of the terminals, first ones of the terminals of the both pairs, 74*a* and 73*a*, are connected respectively to the coils 24 and 24*a* of the air pump 11, while the other ones 74 and 73 of the terminals are connected to the power source AC (see also FIG. 19). In the upper inner surface of the housing 62, it is preferable to form recesses 75 and 75*a* for seating therein the balls 67 and 67*a* at positions separated by 90 degrees at the rotary angle from the inlet and outlet ports 60 and 61.

Figures 19, 20, 21, 22, 23:
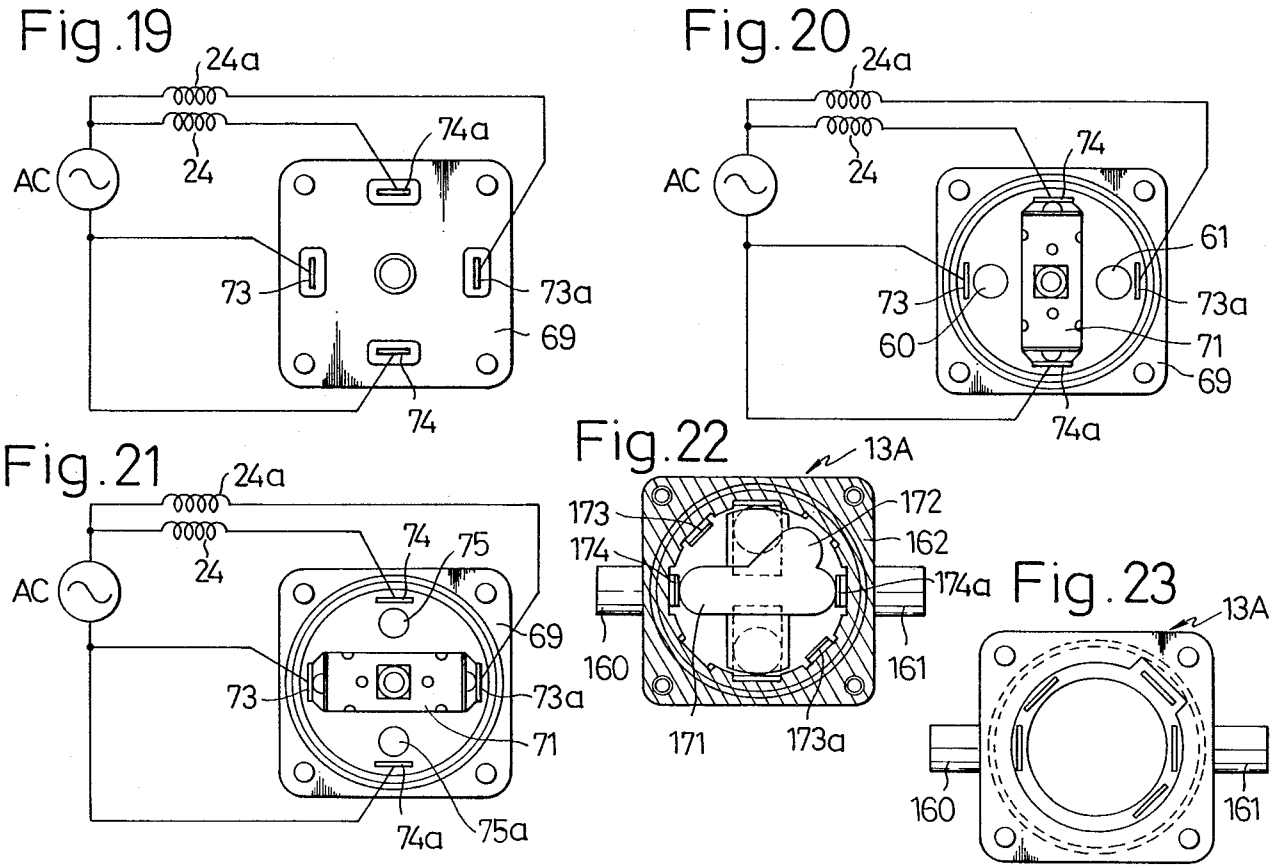
FIGS. 19 to 21 are views for explaining the operation of the valve of FIG. 15.
FIG. 22 is a cross sectional view in another aspect of the air shut-off valve applicable to the controller of FIG. 1.
FIG. 23 is a plan view of the valve of FIG. 22.
Figure 24:
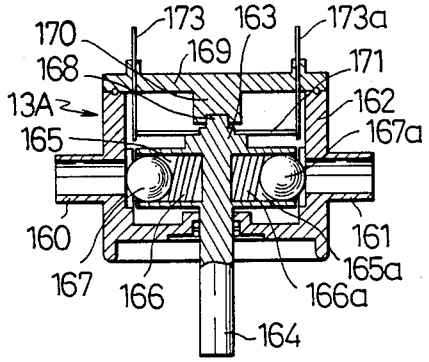
FIG. 24 is a vertically sectioned view of the valve of FIG. 22.
Figure 25:
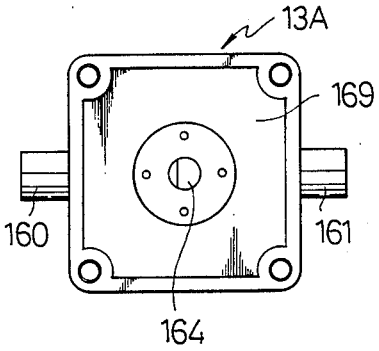
FIG. 25 is a bottom view of the valve of FIG. 22.

In the foregoing air shut-off valve 13, as shown in FIG. 20, the operating portion 64 of the operating member 63 is operated to have the member 63 rotated to cause the balls 67 and 67*a* seated in the recesses 75 and 75*a* and the movable contactor 71 contacted with the pair of terminals 74 and 74*a*, only the coil 24 is thereby excited, the inlet and outlet ports 60 and 61 are brought into communication with each other through the interior of the housing 62, the air fed from the pump 11 to the inlet port 60 is led through the outlet port 61 and hose 18*a* to the air cells 18 to be discharged thereout. It will be appreciated that, with this air dischange, the surface area of the entire bedsore preventing mattress 19 is attempted to be dried.

As shown in FIG. 21, on the other hand, the operating member 63 is rotated by 90 degrees from the position of FIG. 20 to have the balls 67 and 67*a* seated at the inner edges of the inlet and outlet ports 60 and 61, whereby the both ports are simultaneously closed to shut off the air communication between the ports, the air feed to the air cells 18 of the mattress 19 is no more carried out, and the air discharge over the surface of the mattress 19 is halted. At this occasion, the movable contactor 71 is disposed between the terminals 73 and 73*a* and only the coil 24*a* is excited here.

According to the air shut-off valve 13 of the present invention, therefore, the air cells 18 of the bedsore preventing mattress 19 can be selectively operated and, with such integrally provided electric switch 14A as the one having the normally closed and normally opened contacts NC and NO of FIG. 5(*a*), the variable air feed controller 10 can be simplified.

Referring now to FIGS. 22 through 25, there is shown the air shut-off valve in another aspect. An air shut-off valve 13A shown here comprises a box-shaped housing 162 having horizontally extended inlet and outlet ports 160 and 161 and opened upward at top end, and operating member 163 rotatably disposed in a circular cavity within the housing 162. The operating member 163 is provided with an axial operating portion 164 extended downward to project out of the housing 162, and with a pair of peripheral recesses 165 and 165*a* opened in radial directions at positions to be aligned with the inlet and outlet ports 160 and 161 of the housing 162. Within these recesses 165 and 165*a*, a pair of compression springs 166 and 166*a* as well as a pair of balls 167 and 167*a* are disposed so that the balls will be biased by the springs in radially horizontal directions to be slidably urged against the inner periphery of the circular cavity in the housing 62. Thus the balls 167 and 167*a* are engageable in inner peripheral edges of the inlet and outlet ports 160 and 161 so as to close these ports upon such engagement under spring loads of the compression coil springs 166 and 166*a*.

In the inner periphery of the circular cavity of the housing 162, there are provided six other recesses than the inner peripheral edges of the inlet and outlet ports 160 and 161, that is, eight recesses including the both ports 160 and 161, substantially at regular intervals at every 45 degrees position in the rotary angle. At the top face of the operating member 163, an axial pivoting projection 168 is provided to project upward and born in a receptacle 170 made in the inner face of a terminal plate 169 fitted airtightly to the upward open end of the top end of the housing 162. At the top end of the operating member 163, there is secured a movable contactor 171 having three contacting ends including diametrally opposing contacting ends 172 and 172*a* separating from each other by 180 degrees at the rotary angle and an additional contacting end 172A separating from one of the diametrally opposing contacting ends by 45 degrees at the rotary angle in counterclockwise direction in the drawings, while the movable contactor 171 is disposed in top plan view to be separated by 90 degrees at the rotary angle from the positions of the balls 167 and 167*a*. In the terminal plate 169, on the other hand, there are vertically planted a pair of terminals 174 and 174*a* positioned in two diametrally opposing recesses in the inner periphery of the circular cavity of the housing 162, which recesses being separated by 90 degrees in the rotary angle from the inlet and outlet ports 160 and 161, and a further pair of terminals 173 and 173*a* positioned in two further diametrally opposing recesses separating by 45 degrees in the rotary angle from the foregoing recesses for the terminals 174 and 174*a*, so as to be contactable with the three contacting ends of the movable contactor 171. First ones 174*a* and 173*a* of the two pairs of the terminals are connected to the coils 24 and 24*a* of the air pump 11, while the other ones 174 and 173 are connected to the power source AC (see also FIGS. 26 to 29).

Figure 26:
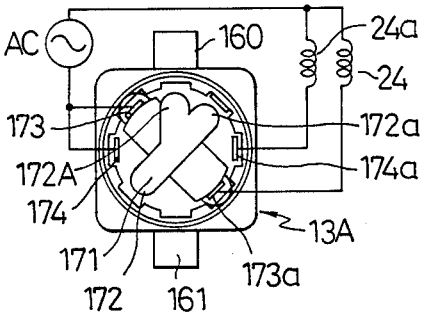
FIGS. 26 to 29 are explanatory views for the operation of the shut-off valve of FIG. 22.
Figure 27:
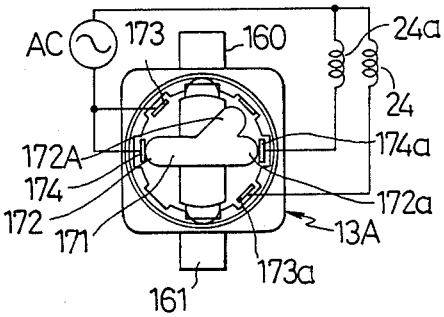
Figure 28:
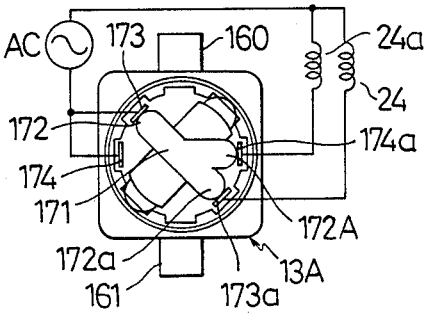
Figure 29:
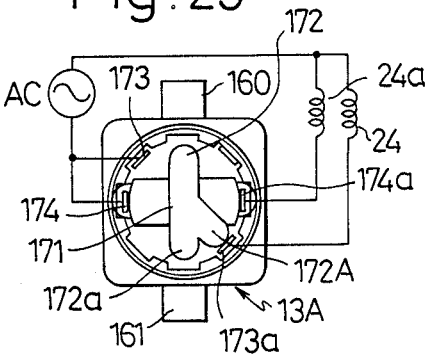

When, in the foregoing aspect of the air shut-off valve, the balls 167 and 167*a* of the operating member 163 are engaged in a pair of opposing recesses in the peripheral surface of the circular cavity at a position shown in FIG. 26 where neither one of the three contacting ends 172, 172*a* and 172A is in contact with either pair of the terminals 173, 173*a* and 174, 174*a*, the inlet and outlet ports 160 and 161 are communicating wit each other through the circular cavity but neither one the coils 24 and 24*a* is excited so that the pump 1 is in halt state. As the operating member 163 is rot from the halt state of FIG. 26 by 45 degrees in the angle in the clockwise direction to a position of 27, next, the balls 167 and 167*a* are caused to be at the inner edges of the inlet and outlet ports 161 to close the both ports, while the contacting 172 and 172*a* of the movable contactor 171 come into with the terminals 174 and 174*a*, and the coil only is energized. As the operating member 163 is rotated by 90 degrees in the rotary angle as in FIG. from the halt position of FIG. 26, the balls 167 and 167*a* come to an engagement in next stage recesses with respect to the inlet and outlet ports 160 and 161 in the clockwise direction, while the three contacting ends 172, 172*a* and 172A of the movable contactor 171 are brought into contact with terminals 173, 173*a* and 174*a*, and the both coils 24 and 24*a* are connected through these terminals and movable contactor to the power source AC to be thereby energized simultaneously. Further when the operating member 163 is rotated by 135 degrees in the rotary angle from the halt position of FIG. 26 to a position of FIG. 29, the balls 167 and 167*a* are engaged in the recesses in the peripheral surface of the cavity which separating by 90 degrees in the rotary angle, and the movable contactor 171 is in contact only at the contacting end 172A with the terminal 173*a*, in which event the inlet and outlet parts 160 and 161 communicate with each other through circular cavity in the body but the coils 24 and 24*a* are not excited due to that the movable contactor 171 is brought into contact only with a single terminal, and substantially the same halt position as in FIG. 26 is achieved here.

According to the above described air change-over valve as shown in FIGS. 22 to 25, the ventilating air cells 18 can be selectively operated while such variable air feeding electric switch 14 as shown in, for example, FIG. 4(*a*) can be integrally provided, so as to be contributive to the simplification of the controller 10, the same as the air shut-off valve of FIGS. 15 and 16.

According to the bedsore-preventing mattress controller according to the present invention, it should be appreciated here that the inflation and deflation of the first and second group air cells as cell as the ventilation with the discharge air cells can be effectively accomplished without requiring and complicated electric control circuit but substantially mechanical and simplified arrangement.

What we claim as our invention is:

1. A controller for a bedsore preventing air mattress including first and second groups of air cells inflatable and deflatable and a plurality of air discharging cells disposed between respective said air cells of said first and second groups, the controller comprising an air pump including coils for generating megnetomotive forces proportional to feed air amount of said pump in a plurality of stages, an air-flow change-over valve receiving fed air from said pump and communicating with said first and second groups of air cells for alternately inflating and deflating the groups, and an air shut-off valve communicating with said air discharging air cells for discharging said fed air thereout and halting said discharging and including an electric switch for changing over said generation of said megnetomotive forces of said air pump, said shut-off valve having means for actuating said electric switch for simultaneous operation therewith.

2. A controller according to claim 1, wherein said coils in said air pump are provided in a pair, an actuation of which is changed over by said electric switch, and said pair of the coils are different in ampere turn.

3. A controller according to claim 2, wherein said electric switch is provided for changing over electric power feeding to said pair of coils.

4. A controller according to claim 2, wherein said electric switch is provided for changing over an electric power feeding to each of said coils and a simultaneous power feeding to both of the coils.

5. A controller according to claim 1, wherein said coils in said air pump are provided in a pair, an actuation of which is changed over by said electric switch, and said pair of the coils are identical in ampere turn.

6. A controller according to claim 5, wherein said electric switch is provided for changing over an electric power feeding to said pair of coils.

7. A controller according to claim 5, wherein said electric switch is provided for changing over an electric power feeding to each of said coils and a simultaneous power feeding to both of the coils.

8. A controller according to claim 1, wherein said air shut-off valve comprises a housing in which said electric switch is integrally assembled, and an operating means operatably housed within said housing for carrying out said air discharging and halting thereof with respect to said air discharging cells as well as said magnetomotive force generation through said electric switch.

9. A controller according to claim 8, wherein said operating means is rotatably supported within said housing and including shiftable balls for opening and closing ports made in the housing for an air flow to said air discharging cells, and said electric switch is also provided rotatably.

10. A controller according to claim 9, wherein said operating means further comprises recesses for receiving therein said balls under a spring load and a shaft part for pivoting the operating means in said housing, and said rotatable electric switch comprises a movable contactor mounted to said operating means.

11. A controller according to claim 10, wherein said electric switch comprises a terminal plate having a plurality of pairs of terminals respectively connected to said coils of said air pump and connectable to an electric power source, said terminals of said pairs being arranged on said terminal plate at positions for contact therewith of said movable contactor on said operating means and for non-contact therewith of the movable contactor depending on a rotating position of the operating means.

12. A controller according to claim 11, wherein said coils in said air pump are provided in .a pair, and said electric switch includes two pairs of said terminals on said terminal plate and two contacting parts in said movable contactor for changing over electric power supply to said pair of coils.

13. A controller according to claim 11, wherein said coils in said air pump are provided in a pair, and said electric switch includes two pairs of said terminals on said terminal plate and three contacting parts in said movable contactor which are contactable with three of said terminals so as to simultaneously connect said pair of coils to said electric power source at one of the rotary positions of said rotatable operating means, for changing over electric power feeding to one of the coils and simultaneously to both of the coils.

14. A controller according to claim 1, wherein said air flow change-over valve comprises a body including three connecting ports for communication with said air pump and said first and second groups of said air cells and one discharge port, a rotary member disposed in said body for rotation therein by an associated driving source, and means provided in said rotary member for communication between one of said connecting ports connected to said air pump and either one of remaining two of the connecting ports connected to said first and second groups of air cells and between said discharge port and said one of remaining two of the connecting ports.

15. A controller according to claim 14, wherein said communication means comprises a pair of recesses made in a surface of said rotary member respectively extending arcuately substantially by 90 degrees in rotary angle in circumferential direction, and said three connecting ports and said discharge port of said body are disposed respectively at intervals of 90 degrees in the rotary angle.

16. A controller according to claim 15, wherein said communicating recesses of said rotary member are provided for taking one of communicating states in one of which the connecting port to said air pump communicates with one of remaining two of the connecting ports and in the other of which the discharge port communicates with said one of said remaining connecting ports, as well as a non-communicating state in which each of said communicating recesses is not communicating with two adjacent ports.

17. A controller according to claim 14, wherein said air flow change-over valve further comprises a reduction gear means integrally provided together with said driving source, said reduction gear means having an output shaft linked with said rotary member.

* * * * *